US006720855B2

(12) United States Patent
Vicci

(10) Patent No.: US 6,720,855 B2
(45) Date of Patent: Apr. 13, 2004

(54) MAGNETIC-FLUX CONDUITS

(75) Inventor: Leandra Vicci, Siler City, NC (US)

(73) Assignee: The University of North Carolina - Chapel Hill, Chapel Hill, NC (US)

( * ) Notice: Subject to any disclaimer, the term of this patent is extended or adjusted under 35 U.S.C. 154(b) by 0 days.

(21) Appl. No.: 10/092,586

(22) Filed: Mar. 8, 2002

(65) Prior Publication Data

US 2003/0169142 A1 Sep. 11, 2003

(51) Int. Cl.[7] ..... H01F 17/06
(52) U.S. Cl. ..... 336/178; 29/602.1
(58) Field of Search ..... 336/174, 175, 336/178, 212; 29/602.1, 603.61, 604–607, 825, 874, 876, 877, 881, 885

(56) References Cited

U.S. PATENT DOCUMENTS 5,130,686 A 7/1992 Leupold
5,719,544 A * 2/1998 Vinciarelli et al. ..... 336/84 C

OTHER PUBLICATIONS

Li Yu–Zhi et al., "Negative Argument on the Existence of Flux Concentrating Effect in the Flux Concentrator", Acta Physica Sinica, Sep. 1983, pp. 1118–1126, vol. 32, No. 9, Institute of Scientific and Technical Information of China (ISTIC), Science Press Beijing, China.

Li Yuzhi et al., "No Flux Concentrating Effect in the Flux Concentrator Generating High Intensity Pulse Magnetic Field", Kexue Tongbao, Jul. 1981, pp. 669–670, vol. 26, No. 7, Academia Sinica, Science in China Press, Beijing, China.

(List continued on next page.)

*Primary Examiner*—Tuyen T. Nguyen
(74) *Attorney, Agent, or Firm*—Burns, Doane, Swecker & Mathis, L.L.P.

(57) ABSTRACT

A magnetic flux guiding apparatus comprises a conduit having a wall that comprises an electrically conducting material. An electrically insulating gap is formed in the wall along an entire length of the conduit. The electrically insulating gap prevents the conduit from having a closed electrical path that links any of the desired magnetic flux paths. For example, the electrically insulating gap can prevent the conduit from having a closed electrical path that surrounds a lengthwise axis of the conduit. The apparatus can also comprise a magnetic-field source that produces a magnetic flux that passes through an interior region bounded by the conduit. Where the conduit comprises a conventional electrically conducting material, the magnetic-field source can be a source of time-varying magnetic flux, such as an electrical coil. Where the conduit comprises an electrically superconducting material, the magnetic-field source can also be a source of time-varying magnetic flux or constant magnetic flux, such as a permanent magnet.

28 Claims, 10 Drawing Sheets

OTHER PUBLICATIONS

T. Yoshimoto et al., "3–D Finite Element Analysis of Flux Reflection and Flux Concentration Effects of Eddy Currents", IEEE Transactions on Magnetics, Sep. 1986, pp. 834–836, vol. MAG–22, No. 5, Institute of Electrical and Electronics Engineers (IEEE), Piscataway, NJ.

T. Yoshimoto et al., "Three Dimensional Flow of Eddy Currents in Flux Concentration Apparatus", IEEE Transactions on Magnetics, Mar. 1990, pp, 1007–1010, vol. 26, No. 2, Institute of Electrical and Electronics Engineers (IEEE), Piscataway, NJ.

T. Yoshimoto et al., "Three Dimensional Analysis of a Cylinder–Type Flux Concentration Apparatus", IEEE Transactions on Magnetics, Nov. 1988, pp. 3150–3152, vol. 24, No. 6, Institute of Electrical and Electronics Engineers (IEEE), Piscataway, NJ.

T. Yoshimoto et al. "3–D Distribution of Flux Density and Inference About Scalar Potential in a Flux Concentration Model", IEEE Transactions on Magnetics, Sep. 1987, pp. 3041–3043, vol. MAG–23, No. 5, Institute of Electrical and Electronics Engineers (IEEE), Piscataway, NJ.

Takeshi Yoshimoto et al., "Four Component Three Dimensional FEM Analysis of Flux Concentration Apparatus with Four Plates", IEEE Transactions on Magnetics, Jan. 1988, pp. 126–129, vol. 24, No. 1, Institute of Electrical and Electronics Engineers (IEEE), Piscataway, NJ.

L.L. Libby, "Special Aspects of Balanced Shielded Loops", Proceedings of the I.R.E., Sep. 1946, pp. 641–646, vol. 34, No. 9, Institute of Radio Engineers (IRE), Piscataway, NJ.

* cited by examiner

PRIOR ART

FIG. 3A
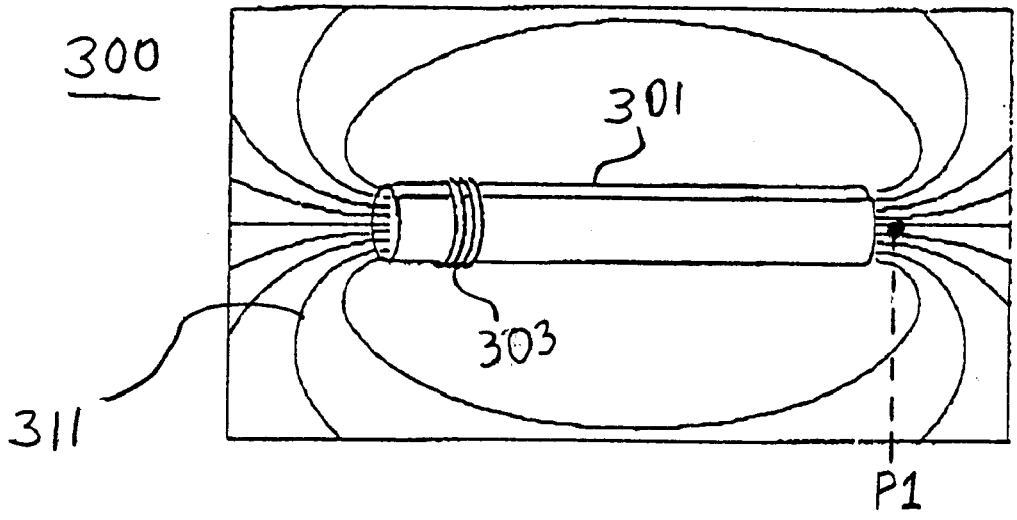
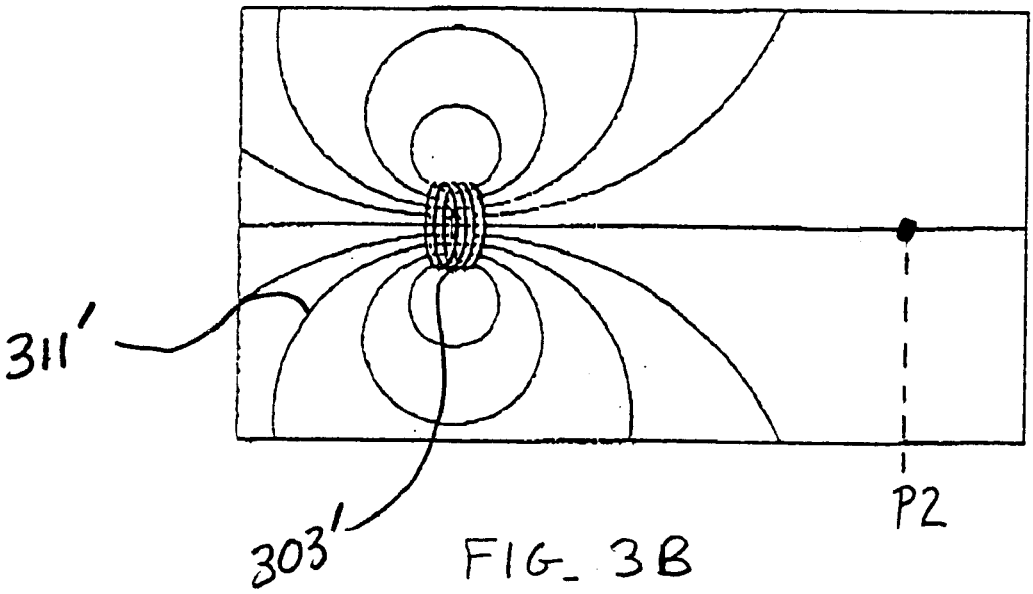
FIG. 3B

MAGNETIC-FLUX CONDUITS

BACKGROUND

1. Field of the Invention

The present invention relates to guiding a magnetic flux. More particularly, the invention relates to guiding a magnetic flux using an electrically conducting conduit that has at least one electrically insulating gap that prevents the conduit from having a closed electrical path that links any closed path of the desired magnetic flux.

2. Background Information

The use of permeable magnetic cores to guide magnetic flux from one region to another in an electrical transformer is known. The term "magnetic flux" refers to the aggregate magnetic induction B passing through an open mathematical surface bounded by a closed path. A conventional electrical transformer 100 is illustrated in FIG. 1. The conventional electrical transformer 100 comprises a permeable magnetic core 101, such as iron, a primary electrical winding 103 that surrounds a first portion of the core 101 and a secondary winding 105 that surrounds a second portion of the core 101. When an alternating current is applied to the primary winding 103, a time-varying magnetic flux is produced, which passes through a region bounded by the primary winding 103. This magnetic flux is guided by the magnetic core 101 through a region bounded by the secondary winding 105. The time-varying magnetic flux thus guided to the interior region of the secondary winding 105 produces an alternating current in the secondary winding according to the mutual inductance between the primary winding 103 and the secondary winding 105.

While permeable magnetic cores in transformers are generally effective in guiding magnetic flux from a primary winding to a secondary winding, such magnetic cores suffer from some disadvantages. For example, magnetic cores can support a magnetic flux only up to the saturation magnetization of the magnetic material from which the core is made. Magnetic cores also suffer from hysteresis and eddy-current core loss. Moreover, conventional magnetic cores are nonlinear (B does not vary linearly with H), and magnetic cores are heavy.

The use of electrical shields, such as in coaxial cables, in microwave cavities, in "IF cans" (intermediate frequency tuned transformers used in superheterodyne radios) and in shielded loop antennas, is also known. Such shields comprise an electrically conductive shell that surrounds a volume to be shielded. However, such shields are not capable of guiding a magnetic flux to pass through a region bounded by the shield.

SUMMARY

Applicant has recognized a need for an approach for guiding a magnetic flux that does not suffer from the above-noted disadvantages associated with permeable magnetic cores of conventional transformers. The present invention fulfills this and other needs. The present invention is useful, for example, in electrical transformers and can be used to provide desired (e.g., intense) magnetic fields in measurement apparatuses that measure properties of a substance in the presence of an applied magnetic field. However, the present invention is not limited to these uses.

According to one aspect of the invention, there is provided a magnetic flux guiding apparatus. The apparatus comprises a conduit having a wall that comprises an electrically conducting material. An electrically insulating gap is formed in the wall along an entire length of the conduit. The insulating gap prevents the conduit from having a closed electrical path that links any closed path of the desired magnetic flux. For example, the insulating gap can prevent the conduit from having a closed electrical path that surrounds a lengthwise axis of the conduit. The apparatus also comprises a magnetic-field source disposed in proximity to the conduit. The magnetic-field source is configured to produce a magnetic flux that passes through an interior region bounded by the conduit.

In another aspect of the invention there is provided a method of making a magnetic-flux conduit. The method comprises identifying one or more mathematical surfaces through which leakage of magnetic flux is to be prevented and providing an electrically conducting material that conforms to the mathematical surfaces. Moreover, the method comprises providing an electrically insulating gap in the electrically conducting material such that no closed electrical path of the electrically conducting material links any closed path of the desired magnetic flux. The electrically insulating gap can be configured to prevent the conduit from having a closed electrical path that surrounds a lengthwise axis of the conduit.

In another aspect of the invention, there is provided another method of making a magnetic-flux conduit. The method comprises identifying one or more mathematical surfaces that surround a region through which a magnetic flux is to be directed wherein the surfaces are surfaces through which leakage of the magnetic flux is to be prevented. The method further comprises providing an electrically conducting material that encloses said one or more surfaces and providing an electrically insulating gap in the electrically conducting material that prevents the electrically conducting material from having a closed electrical path that links any closed path of the desired magnetic flux. The electrically insulating gap can be configured to prevent the conduit from having a closed electrical path that surrounds a lengthwise axis of the conduit.

In another aspect of the invention, there is provided a method of providing a magnetic flux. The method comprises providing a conduit having a wall that comprises an electrically conducting material, wherein an electrically insulating gap is formed in the wall along an entire length of the conduit. The electrically insulating gap prevents the conduit from having a closed electrical path that links any closed path of the desired magnetic flux. The electrically insulating gap can be configured to prevent the conduit from having a closed electrical path that surrounds a lengthwise axis of the conduit. The method further comprises providing a magnetic-field source in proximity to the conduit, and operating the magnetic-field source to produce a magnetic flux that passes through an interior region bounded by the conduit.

In another aspect of the invention, there is provided an electrical transformer. The transformer comprises a conduit having a wall that comprises an electrically conducting material, wherein an electrically insulating gap is formed in the wall along an entire length of the conduit. The electrically insulating gap can prevent the conduit from having a closed electrical path that surrounds a lengthwise axis of the conduit. In addition, the electrically insulating gap can prevent the conduit from having a closed electrical path that links any closed path of the magnetic flux produced by the primary winding. The transformer also comprises a primary electrical winding that surrounds a first portion of the conduit and a secondary electrical winding that surrounds a second portion of the conduit. The conduit can be configured in an overall toroidal shape or in a linear shape with two opposing open ends.

In the above-noted aspects, the conduit can be hollow, or, alternatively, can be filled with an electrically insulating material, such as a thermoplastic resin, for example. As another alternative, one or more permeable magnetic cores can be disposed within the conduit such that the magnetic cores do not electrically short the electrically insulating gap of the conduit. Where the conduit comprises a conventional electrically conducting material, the magnetic-field source can be a source of time-varying magnetic flux, such as an electrical coil. Where the conduit comprises an electrically superconducting material, the magnetic-field source can be a source of time-varying magnetic flux or constant magnetic flux, such as a permanent magnet.

In addition, the conduit can be configured such that the magnetic-field source is disposed in proximity to a first portion of the conduit having a first interior cross-sectional area and such that a second portion of the conduit has a second interior cross-sectional area that is smaller than the first interior cross-sectional area. In this manner, the conduit can focus the magnetic flux at the second portion. For example, the interior region bounded by the conduit can have a tapered shape, such as a conically tapered shape, located between the first portion and the second portion. An end of the tapered section can be configured in proximity to an end of the conduit.

It should be emphasized that the terms "comprises" and "comprising", when used in this specification, are taken to specify the presence of stated features, integers, steps or components; but the use of these terms does not preclude the presence or addition of one or more other features, integers, steps, components or groups thereof.

BRIEF DESCRIPTION OF THE FIGURES

FIG. 3A is a schematic illustration of magnetic flux being guided by an exemplary magnetic flux guiding apparatus according to an aspect of the present invention.

FIG. 3B is a schematic illustration of magnetic flux emanating from a conventional coil for comparison with FIG. 3A.

DETAILED DESCRIPTION

Figure 1:
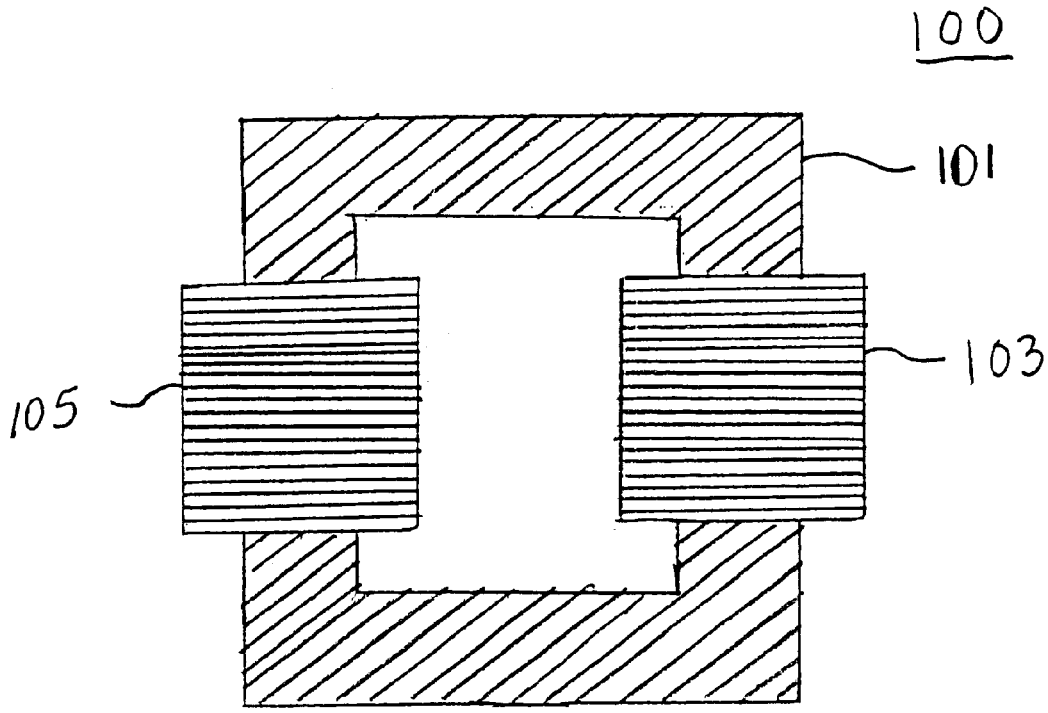
FIG. 1 is a cross-sectional schematic illustration of a conventional magnetic-core electrical transformer.
Figure 2A:
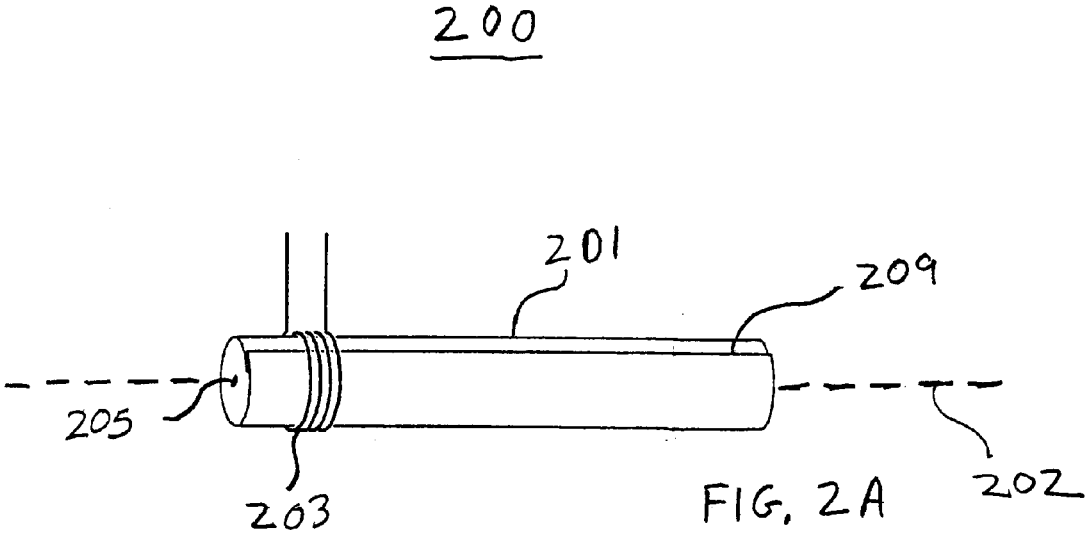
FIG. 2A is a schematic illustration of an exemplary magnetic flux guiding apparatus according to an aspect of the invention.
Figure 2B:
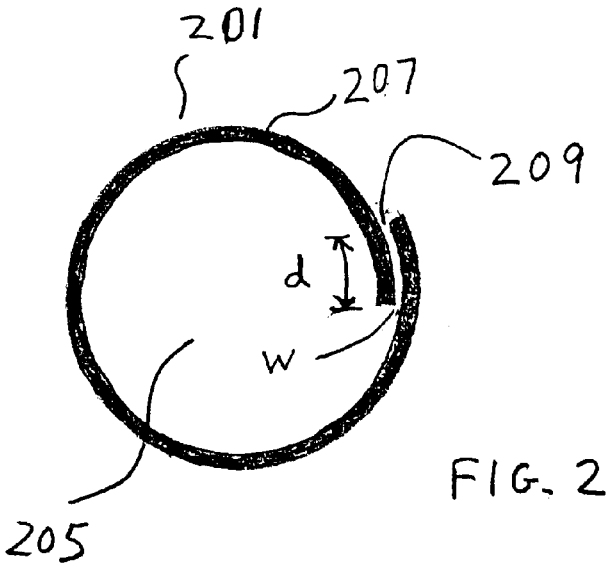
FIG. 2B is a cross-sectional view of the conduit illustrated in FIG. 2A.

According to one aspect of the invention, there is provided a magnetic flux guiding apparatus. FIGS. 2A and 2B illustrate an exemplary magnetic flux guiding apparatus 200 according to an aspect of the present invention. As illustrated in FIG. 2A, the magnetic flux guiding apparatus 200 comprises an electrically conducting conduit 201 and a magnetic-field source 203. The conduit 201 has an interior region 205, and the magnetic field source generates a time-varying magnetic flux that passes through the interior region 205 of the conduit 201. The conduit 201 has an electrically insulating gap 209 that extends along the entire length of the conduit 201. In the example of FIG. 2A, the electrically insulating gap 209 extends parallel to a lengthwise axis 202 of the conduit 201. The magnetic field source 203 can be an electrical coil which can be driven by an alternating current. In the example of FIG. 2A, the interior region 205 of the conduit 201 is hollow.

FIG. 2B provides a cross-sectional view of the conduit 201. As shown in FIG. 2B, the conduit 201 has a wall 207 that comprises an electrically conducting material. For example, the wall 207 can be formed of a thin metallic sheet such as aluminum, copper, silver or other electrically conducting materials. Appropriate thicknesses for the wall 207 of the conduit will be described below. As illustrated in FIG. 2B, two overlapping edges of the wall 207 are disposed adjacent to the gap 209. These overlapping edges overlap a distance d. The electrically insulating gap 209 within this region of overlap has a width w. The electrically insulating gap 209 can be filled with an electrically insulating material such as polyester (e.g., Mylar™), polyvinylchloride (PVC), various plastics, other electrically insulating polymers, paper or any other electrically insulating material. The width w of the gap 209 should be as small as possible while retaining electrical isolation between the two overlapping edges of the wall 207. For example, the width of the gap 209 could be in the range of tens to hundreds of microns for an electrically insulating gap 209 that is filled with polymeric or paper materials. Such conduits according to the present invention have the ability to contain and guide magnetic flux and are also referred to herein as "magnetic-flux conduits."

The magnetic flux guiding apparatus 200 illustrated in FIGS. 2A and 2B can be constructed, for example, by placing a layer of insulation over one edge of a flat metal sheet and by rolling the flat metal sheet into the shape of a cylinder such that another edge of the flat metal sheet is disposed over the electrically insulating layer. For example, a layer of thin polyester tape can be placed in contact with the surface of a thin metal sheet at one edge thereof, and the thin metal sheet can be rolled into the shape of a cylinder such that another end of the thin metal sheet is disposed over and in contact with the polyester tape. The resulting conduit 201 can then be secured by wrapping the outer circumference of the conduit with polyester tape in one or more locations. A coil 203 of electrically insulated wire having an inner coil diameter slightly larger than the outer diameter of the conduit 201 can then be placed over the conduit 201 such as illustrated in FIG. 2A. The coil 203 can be secured to the conduit 201, for example, using conventional adhesives such as epoxy. Alternatively, the coil 203 can be attached to the conduit 201 using any appropriate mechanical fastening mechanism.

The operation of a magnetic flux guiding apparatus according to the present invention will now be described with reference to FIG. 3A. FIG. 3A illustrates an exemplary magnetic flux guiding apparatus 300 like that illustrated in FIG. 2A. The apparatus 300 comprises an electrically conducting conduit 301 and an electrical coil 303. When the electrical coil 303 is energized with an alternating electric current, a time-varying magnetic flux is produced that passes through an interior region bounded by the conduit 301. As shown in FIG. 3A, magnetic flux 311 is generated by the coil 303, is guided through an interior region bounded by the conduit 301, and emanates from an end thereof near point P1. The high density of magnetic field lines corresponding to flux 311 at point P1 reflects a relatively high magnetic field strength in that region. In addition, as illustrated in FIG. 3A, the magnetic flux 311 does not leak through the wall of the conduit 301 but, rather, is confined to the interior region bounded by the conduit 301 until emanating from the end of the conduit 301 near point P1. The magnetic flux 311 emanating from an end of the conduit 301 extends back to the opposing end of the conduit 301 to form closed magnetic field lines.

For purposes of comparison, the magnetic field generated by a conventional coil is shown in FIG. 3B. FIG. 3B illustrates a conventional coil 303' energized with an alternating electrical current. As shown in FIG. 3B, a resulting magnetic field is generated that comprises a magnetic flux 311'. In contrast to the magnetic flux configuration generated by the apparatus 300 illustrated in FIG. 3A, there is very little magnetic flux at point P2 shown in FIG. 3B, whereas there is a substantially strong magnetic flux emanating from the conduit 301 at point P1 as shown in FIG. 3A.

Physical principles relating to the operation of magnetic flux guiding apparatuses according to the present invention will now be described. First, a reason that a magnetic flux can be guided through an interior region bounded by a magnetic-flux conduit according to the present invention will be addressed.

A reason that a magnetic flux can be guided through an interior region bounded by a magnetic-flux conduit according to the present invention (e.g., conduit 201 illustrated in FIG. 2A) is that the electrically insulating gap (e.g., gap 209) prevents the magnetic-flux conduit from having a closed electrical path that links any closed path of the desired magnetic flux. In this regard, the term "links" refers to the concept of one closed loop being linked to another closed loop in the manner that two adjacent loops of a chain are linked together. Because the electrically insulating gap of a magnetic-flux conduit according to the present invention prevents the magnetic-flux conduit from linking any closed path of the desired magnetic flux, no Lentz-law current can be induced in the conduit, and no canceling magnetic field can be produced. Stated differently, the electrically insulating gap prevents a Lentz law current from being induced in a closed electrical path in the magnetic-flux conduit that surrounds a lengthwise axis of the conduit. Accordingly, no induced canceling magnetic field can be generated in the interior region bounded by the conduit.

In contrast, a conventional electrically conducting tube having no electrically insulating gap cannot guide a magnetic flux. For example, if the conduit 201 illustrated in FIG. 2A were replaced with a conventional hollow electrically conducting tube having no electrically insulating gap, a magnetic flux could not be guided through the interior region of such a tube. The reason is that providing an alternating electric current to a coil surrounding a conventional electrically conducting tube during any infinitesimal time interval would lead to a first induced magnetic flux created in the interior region of the tube that would be canceled by a second induced magnetic flux created in the interior region of the tube. In particular, during any infinitesimal time interval, providing a time varying electrical current to a coil surrounding a conventional electrically conducting tube would create a first magnetic flux in a region bounded by the coil. A portion of this region is also encompassed by the tube. The portion of the first magnetic flux in the interior region of the tube would induce an electromotive force (EMF) in the wall of the tube. This EMF would induce a circumferential current in the wall of the tube. This induced current would be generated, by Lentz's law, in a manner that would create a second magnetic flux in the interior region of the tube that would cancel the first magnetic flux within the tube. Of course, because a conventional tube is not expected to be a perfect electrical conductor, it is possible for a very small residual magnetic flux to pass through the interior region of such a conventional tube. However, such a residual magnetic flux is negligible compared to the substantial and intense magnetic flux that can be passed through magnetic-flux conduits according to the present invention.

Another consideration is the mechanism that provides containment of the magnetic flux in an interior region bounded by a magnetic-flux conduit according to the present invention. As explained above, a concept that enables magnetic flux to pass through an interior region bounded by a magnetic-flux conduit is the elimination of Lentz law currents linking the desired flux path. Conversely, preventing the flux from leaking through the walls of a magnetic-flux conduit depends on the induction of eddy currents which generate just the right Lentz law fields to cancel the leakage flux. These effects are alternating-current (AC) effects for magnetic-flux conduits made of conventional electrical conductors. However, if the magnetic-flux conduit is made of a superconducting material, even quasi direct-current (DC) fields experience these properties.

For the AC case, consider an infinitesimal patch of the wall of a magnetic-flux conduit composed of a linear, conducting, but not necessarily magnetic, material. The local magnetic field adjacent to this patch may be treated as the superposition of components parallel and perpendicular to the patch, respectively. The parallel component induces a transverse EMF in the patch, which contributes to the transverse voltage induced around the magnetic-flux conduit. As described above, the conduit topology prevents this voltage from developing any current. So the parallel field component is unaffected by the presence of the patch.

The time variation of the perpendicular component can be treated as a superposition of sinusoidal Fourier components. Consider the behavior of a component with frequency f. The integral form of Faraday's law takes the form $$\oint E \cdot dl = -2\pi j f \phi_B \tag{1}$$

where $j=\sqrt{-1}$ and where $\phi_B$ is the magnetic flux linking the integration path and which is given by $$\phi_B = \int_S B \cdot ds. \tag{2}$$

Taking this path around the edges of the patch, a corresponding perimeter current is developed proportional to the perpendicular $\phi_B$ incident on the patch. The perimeter current is also proportional to the conductivity $\sigma$ of the patch material, according to the differential form of Ohms law $J=\sigma E$, where J is the current density.

A reason for considering this level of detail is to show that the current density J is not necessarily constant through the thickness of the patch. Consider an infinitesimal surface layer of the patch with incident field B, inducing a circulating current in that layer as just described. According to Ampere's law, this current generates an opposing magnetic field (by Lentz's law), which diminishes the strength of the B field incident on the layer beneath by some ratio which depends on the conductivity $\sigma$ of the patch and the frequency f of the field. In this layer, the induced current J is commensurately smaller, and the B field incident on the next layer is again diminished by the same ratio. It is thus evident that the strength of the perpendicular field component falls off exponentially with depth in the patch. This is known as the skin affect, and is the basic mechanism underlying the behavior of electromagnetic shields.

Considerations relating to the choice of the wall thickness of a magnetic-flux conduit will now be described. In view of the above discussion, given an acceptable leakage level for a magnetic-flux conduit, the required wall thickness thus depends on the lowest frequency Fourier component of the field and the electrical conductivity of the wall. For a wall thickness of one "skin depth" the leakage flux is $1/e\approx37\%$ of the internal perpendicular field component. For five skin depths, the leakage would be $1/e^5\approx0.67\%$. For N skin depths, the leakage would be $1/e^N$. The skin depth formula is $\delta=\sqrt{1/\pi f\mu\sigma}$. In SI units, $\mu=\mu_0=1.257\times10^{-6}$ for nonmagnetic conductors. For copper, for example, $\sigma=5.8\times10^7$. So the skin depth at 4 kHz is about 1 mm in copper. Accordingly, an appropriate wall thickness for a magnetic-flux conduit comprising a conventional electrically conducting material can be chosen by considering a tolerable level of magnetic flux leakage and by applying the above-noted formulas for a given electrically conducting material to be used for the magnetic-flux conduit.

For a superconductor, the skin depth is negligible. Therefore, superconducting magnetic-flux conduits can be scaled down to microscopic sizes. The ultimate size limitations are due to quantum mechanical phenomena, such as the Josephson effect. Moreover, for superconductors, the necessary eddy currents are induced during the initial establishment of the field, and persist for as long as the field does not change and the flux conduit remains superconducting. Therefore, superconducting magnetic-flux conduits can be used to guide quasi-DC magnetic fields. Various superconducting materials can be used for magnetic-flux conduits according to the present invention including yttrium-barium-copper-oxide materials (e.g., $YBa_2Cu_3O_{7-x}$), bismuth-strontium-calcium-copper-oxide materials (e.g., $Bi_{1.8}Pb_{0.2}Sr_2Ca_2Cu_3O_{10+x}$), and other high-temperature superconducting materials. Microscopic superconducting magnetic-flux conduits can, in principle, be fabricated from electrically conducting layers disposed on electrically insulating substrates or disposed on electrically insulating layers using conventional photolithographic and etching techniques.

Additional considerations relating to the electrically insulating gap of a magnetic-flux conduit will now be described. As discussed above, a fundamental aspect of magnetic-flux conduits is the introduction of an electrically insulating gap (alternatively referred to as an electrically insulating seam) in an otherwise conducting shell. Such gaps or seams however, themselves provide a leakage path for magnetic flux to escape from the magnetic-flux conduit. Referring to FIG. 2B, an electrically insulating seam such as seam 209 can be characterized by a gap width w and a path length d represented by the amount of overlap between edges of the flux conduit 201. Along an incremental length $\delta\iota$ of such a seam, where a field strength $B_d$ is a component aligned with the path through the seam, the leakage flux is $\delta\phi_\iota=B_d\delta\iota w/d$. Therefore, a good seam design will make the factor w/d small. That is, the gap should be relatively narrow, and the path length through the gap should be relatively long.

Figure 4:
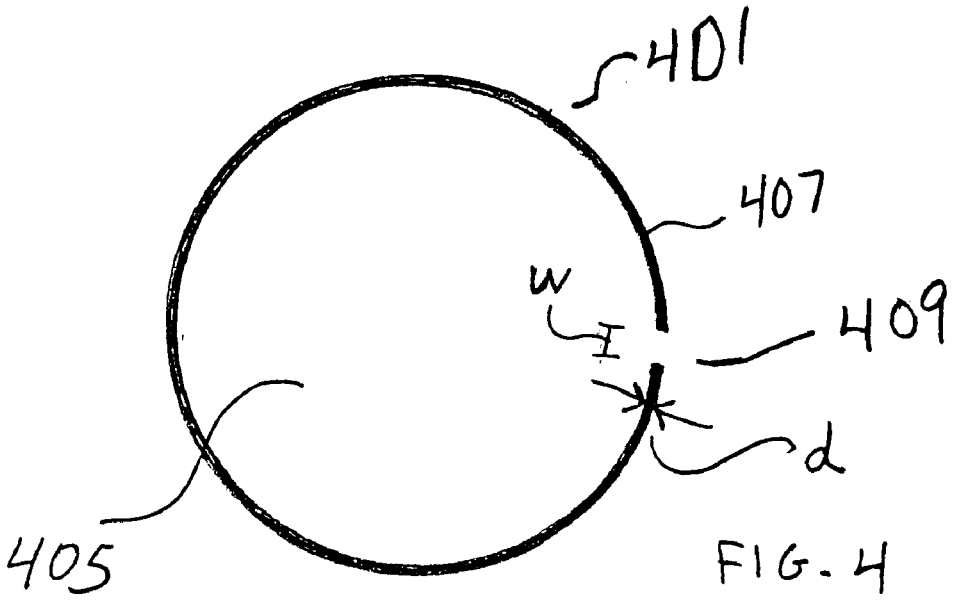
FIG. 4 is a cross-sectional illustration of an exemplary magnetic-flux conduit according to an aspect of the present invention.

Measurements were conducted on two exemplary cylindrical magnetic-flux conduits to demonstrate the above-described seam effect. A cylindrical magnetic-flux conduit according to a first example (Example 1) was configured with a cross-sectional shape as shown in FIG. 4. FIG. 4 illustrates a magnetic-flux conduit 401 that has a wall 407 rolled into a cylindrical shape. The flux conduit 401 comprises a gap 409 formed in the wall of the conduit 401 and has a hollow interior 405. The gap 409 is characterized by a width w and by a path length d as shown in FIG. 4. The magnetic-flux conduit of Example 1 was generated by rolling a sheet of OFHC copper 0.813 mm thick into a cylinder with a diameter of 46 mm and a length of 307 mm. The gap was formed by abutting the edges of the rolled sheet with an intervening electrically insulating layer of Mylar™ (polyester) tape. The gap width was not tightly controlled and was estimated to be 0.1±0.05 mm in width. The path length d through the gap, as reflected in FIG. 4, is the thickness of the copper (0.813 mm). Accordingly, the Example 1 conduit has a w/d factor of w/d=0.12. Thus, this is a rather loose seam and can be expected to leak a significant amount of magnetic flux.

Figure 5:
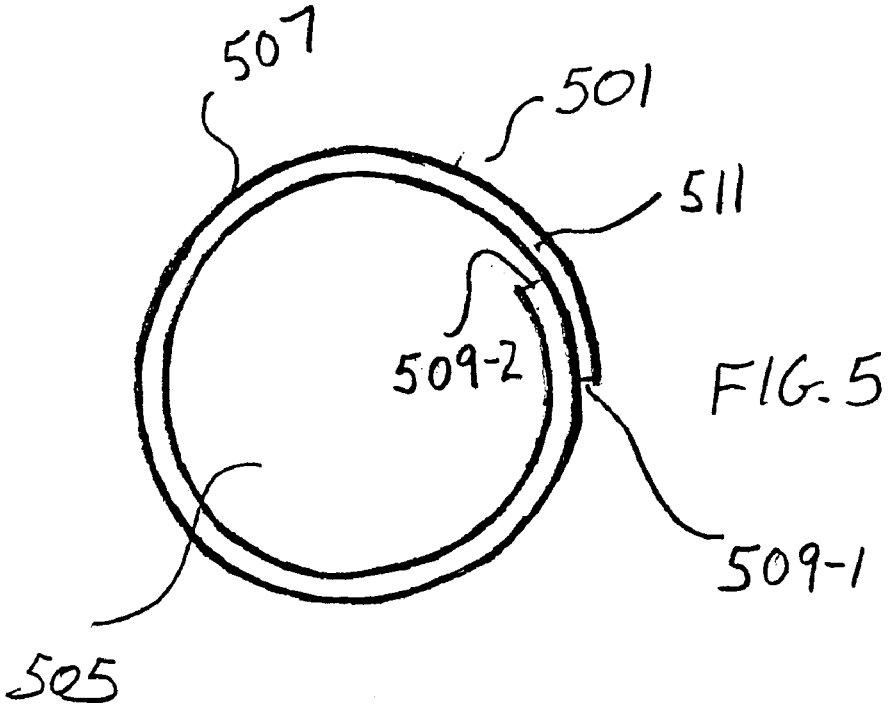
FIG. 5 is a cross-sectional illustration of another exemplary magnetic-flux conduit according to another aspect of the present invention.

A second exemplary magnetic-flux conduit (Example 2) has a spiral cross-sectional configuration, such as shown in FIG. 5. FIG. 5 illustrates a magnetic-flux conduit 501 comprising an electrically conducting wall 507 arranged in the form of a spiral. Although only slightly more than two complete spiral turns are illustrated in FIG. 5, the actual Example 2 magnetic-flux conduit had approximately 7.25 spiral turns. An electrically insulating layer 511 is disposed within a gap 509 between adjacent layers of the wall 507. In addition, the conduit 501 has a hollow interior region 505. The gap 509 is spiral in shape and extends from a first end point of the gap 509-1 to a second end point of the gap

509-2. The Example 2 conduit was formed from a sheet of copper roof flashing (i.e., a thin copper sheet) 0.127 mm in thickness with a layer of polymer film arranged on one side. This arrangement was then rolled approximately 7.25 turns to form a cylinder 45 mm in diameter and 260 mm long. The polymer film was commercially available Saran Wrap™ and was approximately 0.054 mm in thickness. This thickness also corresponds to the gap width w in this example. The path length d through the gap is approximately $6.25\times\pi\times45$ mm≈878 mm. Thus, the example 2 magnetic-flux conduit has a w/d factor of $w/d=6.2\times10^{-5}$. Accordingly, this design provides a very tight seam that is expected to have minimal magnetic flux leakage.

Magnetic-flux leakage measurements were carried out on both the Example 1 and Example 2 magnetic-flux conduits. In particular, both the Example 1 and Example 2 magnetic-flux conduits were arranged in a measurement configuration as illustrated in FIG. 6A, which shows a magnetic-flux conduit 601 equipped with a source coil 603. A test coil 605 is mounted on a wooden dowel 607 that enables placement of the test coil 605 within the conduit 601 at desired positions. For each of the Example 1 and Example 2 magnetic-flux conduits, a source coil such as coil 603 was used to generate a magnetic flux within the magnetic-flux conduit. A test coil like test coil 605 was then moved axially in the interior region bounded by the conduit 601, and measurements of induced voltage were taken from the test coil 605 as a function of distance from an end of the conduit. The B field measured by the test coil 605 as a function of the distance along the length of the flux conduit 601 was then normalized to the B field measured at the source coil location without the flux conduit 601 present to determine a relative B-field ratio as a function of axial distance from a near end of the flux conduit 601 (the near end being the end in proximity to the source coil 603). A comparison of the measurements thus obtained are provided in FIG. 6B.

Figure 6B:
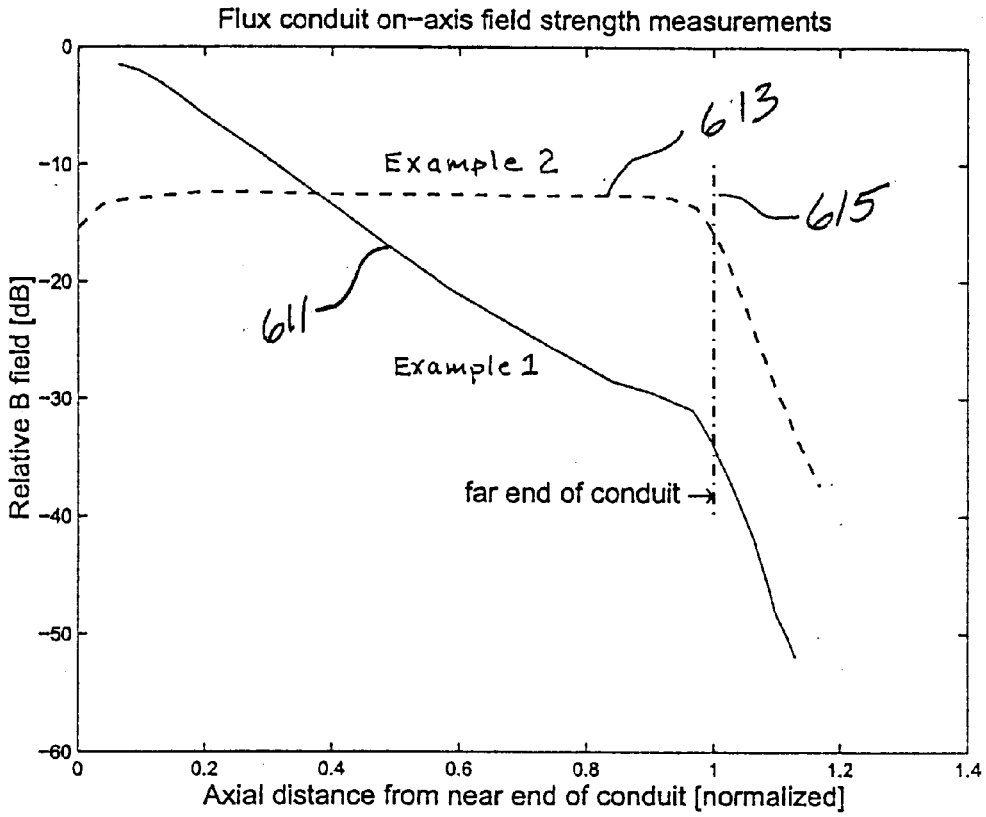
FIG. 6B is a plot of relative magnetic field measured along the axes of two exemplary magnetic-flux conduits similar to those shown in FIGS. 4 and 5.
Figure 6A:
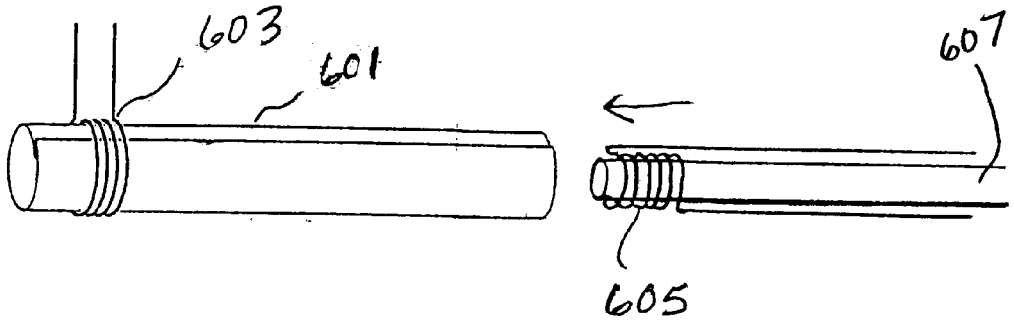
FIG. 6A is a schematic illustration of an exemplary magnetic flux guiding apparatus according to an aspect of the present invention configured with a test coil for measuring leakage of magnetic flux from the magnetic-flux conduit.

FIG. 6B illustrates measurements of relative B field in decibels (dB) as a function of axial distance from the near end of the magnetic-flux conduit (in normalized units). Solid curve 611 corresponds to data taken for the Example 1 (leaky) magnetic-flux conduit, and the dotted line 613 corresponds to data obtained for the Example 2 (tight) magnetic-flux conduit. A line 615 marks where the far end of the magnetic-flux conduit occurs in each example. Data were obtained for both exemplary configurations by driving the source coil at 22 kHz. As reflected by the measurements illustrated in FIG. 6B, the seam leakage of the Example 1 magnetic-flux conduit causes the axial field strength measured by the test coil to drop steadily along its length. In contrast, the Example 2 magnetic-flux conduit maintains its field strength essentially undiminished over its entire length.

It should be noted that magnetic-flux conduits according to the present invention do not increase the magnitude of a B field for a given applied H field as a magnetic core would do. Moreover, if the average path length of the magnetic flux is increased by the use of a magnetic-flux conduit according to the present invention, the average magnitude of the H field (and, therefore, the magnitude of the magnetic flux guided through the interior region bounded by the magnetic-flux conduit) itself is reduced. This effect can be explained as follows. Consider the integral form of Ampere's law given by $$\oint H\cdot dl = I \tag{3}$$

where I is the current linking the integration path. If the integration path follows a flux line, this simply becomes the scalar form $$\oint Hdl = I. \tag{4}$$

Since by construction the conduit does not contribute to I, a longer path length must correspond to a smaller average magnetic field strength for a given driving current. Stated differently, a relatively longer magnetic-flux conduit is expected to have a relatively higher reluctance.

This effect is evident in the measurements of the Example 1 and Example 2 magnetic-flux conduits as shown in FIG. 6B. The magnetic flux leaking through the loose seam of the Example 1 magnetic-flux conduit follows a relative short return path around the coil, resulting in a relatively high magnetic field at the location of the coil, but which drops off with length along the magnetic-flux conduit. In contrast, essentially all the magnetic flux guided through the interior region bounded by the Example 2 magnetic-flux conduit must traverse the entire length of the magnetic-flux conduit, resulting in a longer average path length traveled by the magnetic flux, which results in a correspondingly lower magnetic field strength. However, this magnetic field strength remains constant along the entire length of the Example 2 magnetic-flux conduit.

Figure 7A:
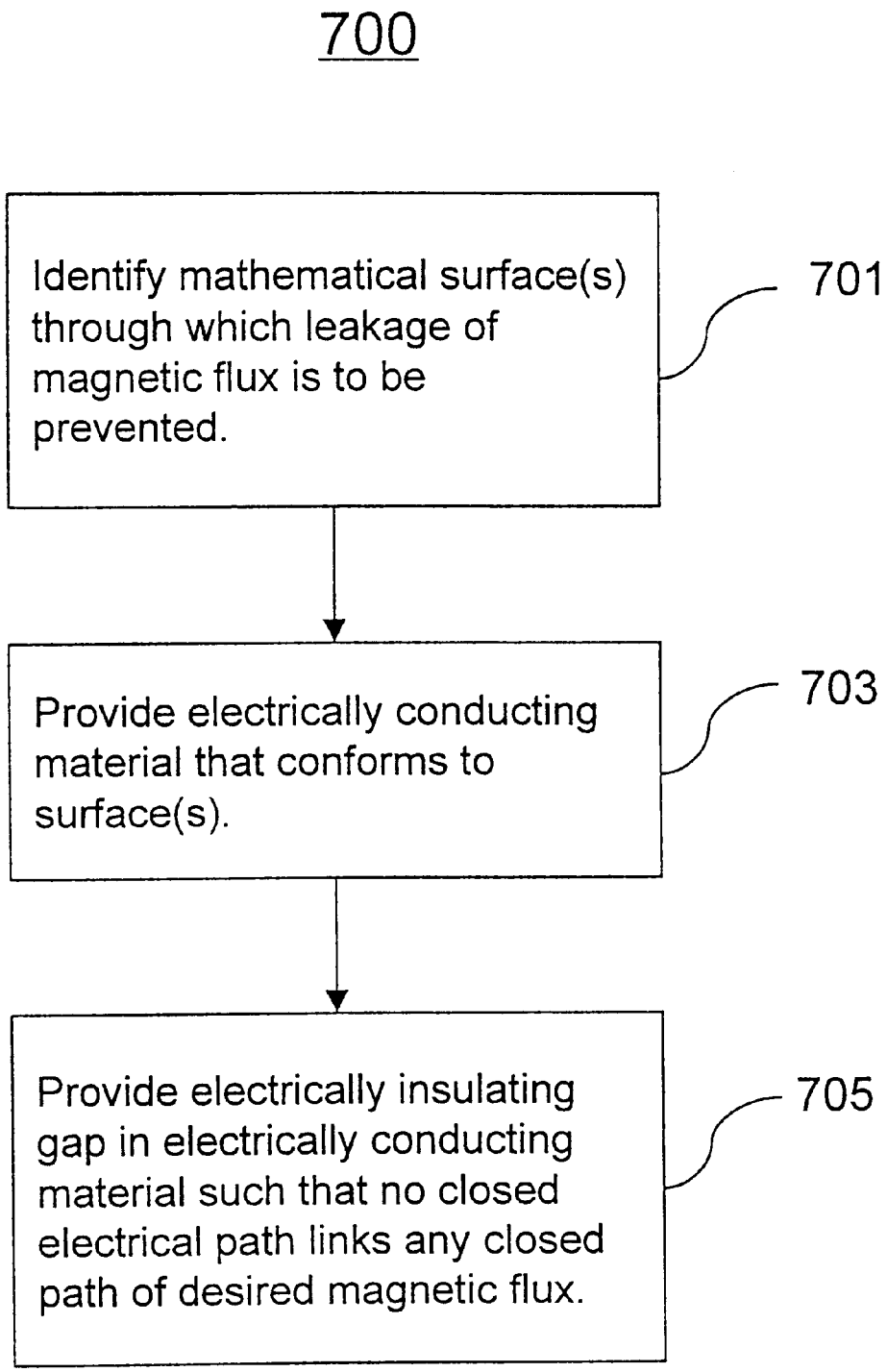
FIG. 7A is a flow diagram of an exemplary method of making a magnetic-flux conduit according to the present invention.

In another aspect of the invention there is provided a method of making a magnetic-flux conduit. An exemplary method 700 of making a magnetic-flux conduit is illustrated in the flow diagram of FIG. 7A. The method 700 comprises identifying one or more mathematical surfaces through which leakage of a desired magnetic flux is to be prevented (Step 701). The method also comprises providing electrically conducting material that conforms to the one or more mathematical surfaces (Step 703). The method further comprises providing an electrically insulating gap in the electrically conducting material such that no closed electrical path of the electrically conducting material links any closed path of the desired magnetic flux (Step 705).

magnetic-flux conduit 201 illustrated in FIGS. 2A and 2B is an example of a magnetic-flux conduit that can be made by the method 700. In particular, for the exemplary magnetic-flux conduit 201, the mathematical surface through which leakage of a desired magnetic flux is to be prevented (Step 701) is a curved cylindrical surface. The mathematical surface can identified (chosen) based on the desired use. For example, where focusing or concentrating a magnetic flux is not desired, a cylindrical surface such as illustrated in FIGS. 2A and 2B with a substantially constant cross-sectional area is convenient. If focusing a magnetic flux is desired, a mathematical surface with a tapered cross-sectional area is desirable, such as shown, for example, in FIGS. 10A–10C and 11A–11B. Of course, appropriate mathematical surfaces are not restricted to these examples. Referring back to the example of FIGS. 2A and 2B, a sheet of electrically conducting material (the wall 207) is rolled up in a manner that conforms to the mathematical cylindrical surface (Step 703). Moreover, an electrically insulating gap 209, filled with an electrically insulating material such as polyester, is provided such that no closed electrical path in the electrically conducting wall 207 links any closed path of the desired magnetic flux. This latter aspect is further illustrated in FIG. 3A with regard to the magnetic-flux conduit 301, such as has been previously described. Of course, the method 700 illustrated in FIG. 7A is not intended to be limited to the examples illustrated in FIGS. 2A, 2B and FIG. 3A.

Figure 7B:
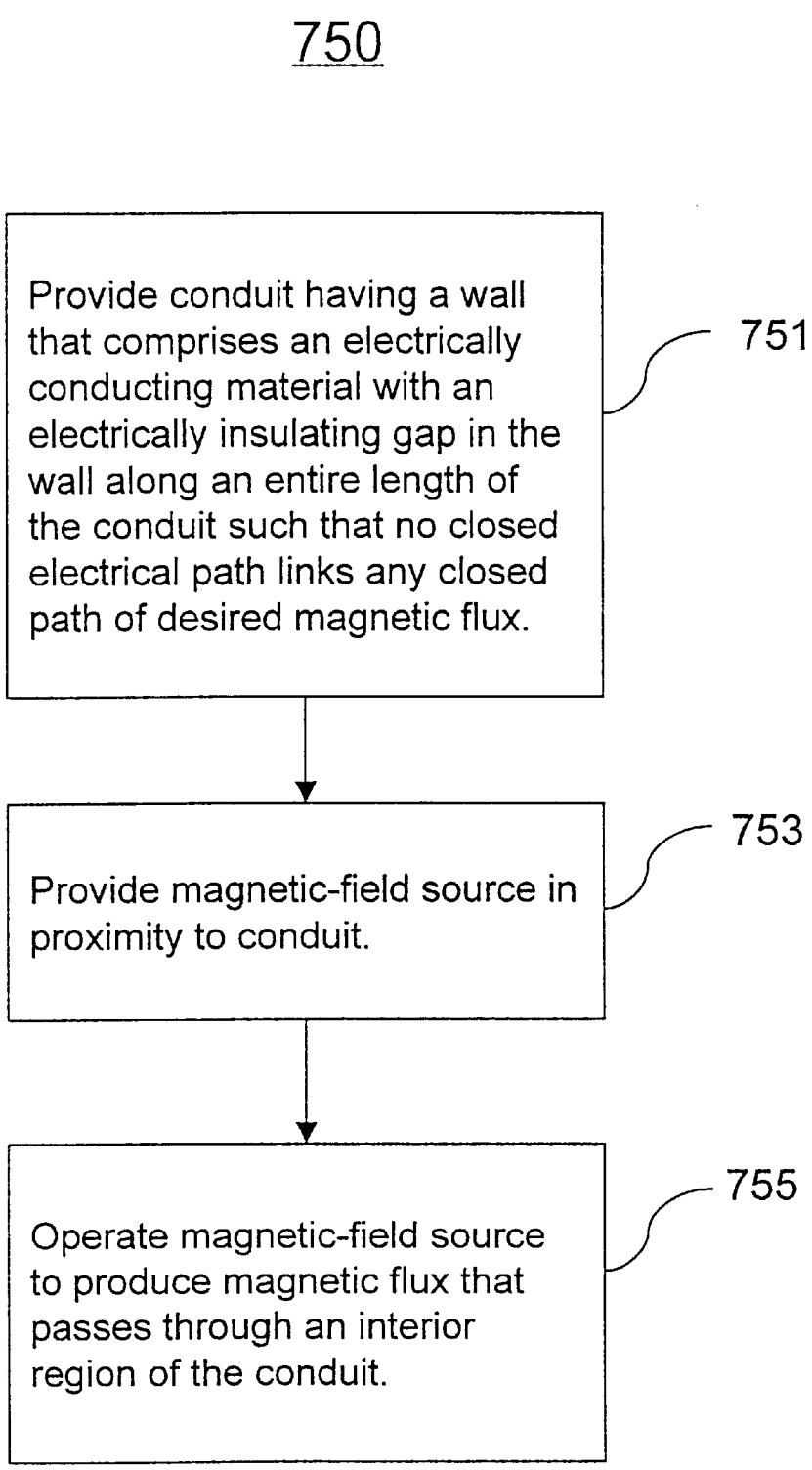
FIG. 7B is a flow diagram of an exemplary method of providing a magnetic flux according to the present invention.

In another aspect of the invention there is provided a method of providing a magnetic flux. An exemplary method 750 of providing a magnetic flux is illustrated in FIG. 7B. As shown in FIG. 7B, the method 750 comprises providing a conduit having a wall that comprises an electrically conducting material, wherein an electrically insulating gap is formed in the wall along an entire length of the conduit, and wherein the electrically insulating gap prevents the conduit from having a closed electrical path that links any closed path of desired magnetic flux (Step 751). The method also comprises providing a magnetic-field source in proximity to the conduit (Step 753). The method further comprises operating the magnetic field source to produce a magnetic flux that passes through an interior region bounded by the conduit (Step 755).

As an example of the method 750, consider the exemplary magnetic-flux guiding apparatus 200 illustrated in FIGS. 2A and 2B. First, the conduit 201 is provided. The conduit has a wall 207 that comprises an electrically conducting material, and an electrically insulating gap 209 is formed in the wall 207 along an entire length of the conduit. The electrically insulating gap prevents the conduit from having a closed electrical path that links any closed path of the desired magnetic flux. This latter aspect is further reflected in FIG. 3A. In addition, a magnetic-field source 203 (e.g., an electrical coil) is provided in proximity to the conduit 201 (Step 753). In the example of FIGS. 2A and 2B, the magnetic field source 203 surrounds a portion of the conduit 201. The magnetic-field source 203 can be operated to produce a magnetic flux that passes through an interior region bounded by the conduit (Step 755). This latter aspect is further illustrated in FIG. 3A. Of course, the method 750 illustrated in FIG. 7B is not intended to be limited to the examples of FIGS. 2A, 2B and FIG. 3A.

Figure 8:
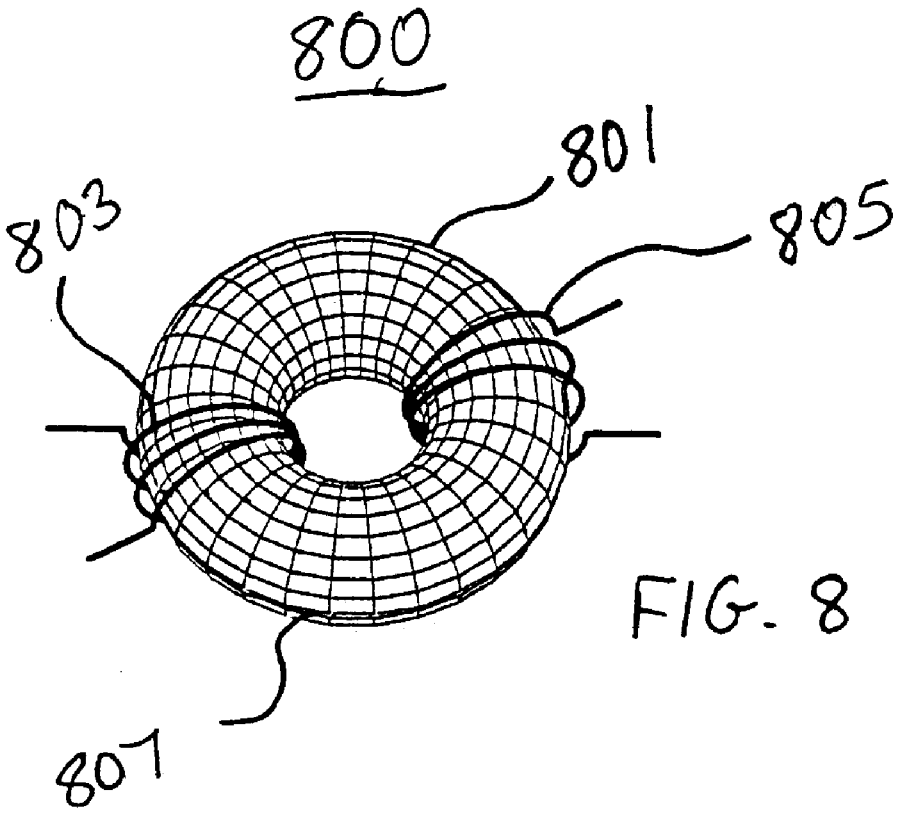
FIG. 8 is a schematic illustration of an exemplary toroidal transformer according to an aspect of the present invention.

In another exemplary aspect of the present invention, there is provided an electrical transformer that comprises a magnetic-flux conduit. FIG. 8 illustrates a toroidal transformer 800 according to an exemplary aspect of the present invention. The transformer 800 comprises an electrically conducting conduit 801 in a toroidal shape. The transformer 800 also comprises a primary electrical winding 803 that surrounds a first portion of the conduit 801 and a secondary electrical winding 805 that surrounds a second portion of the conduit 801. The conduit 801 also has an electrically insulating gap 807 formed along the length of the conduit 801 in the wall of the conduit 801 at a location of greatest diameter of the toroidally shaped conduit 801. The location of the electrically insulating gap 807 is not limited to this location, however, and the electrically insulating gap 807 could alternatively be provided at the minimum toroidal diameter, or elsewhere. Moreover, the conduit 801 can have a plurality of insulating gaps 807 along the length of conduit 801 at a plurality of locations. In addition, the primary and secondary windings 803 and 805, respectively, are each provided with the desired number of turns necessary to achieve the desired step-up or step-down voltage characteristics. Choosing the number of windings to obtain the desired voltage characteristics is within the purview of one of ordinary skill in the art. The conduit 801 can comprise conventional electrical materials such as aluminum, copper, silver or other electrically conducting materials. In addition, the conduit 801 can also comprise superconducting electrical materials such as described previously. The electrically insulating gap 807 can prevent the conduit 801 from having a closed electrical path that surrounds a lengthwise axis (not shown) of the conduit 801. For the conduit 801 which has a toroidal shape, the lengthwise axis can be viewed as a ring-shaped axis located within the conduit 801 at the center of a cross section of the conduit 801. In addition, the electrically insulating gap 807 can prevent the conduit 801 from having a closed electrical path that links any closed path of the magnetic flux produced by the primary winding 803.

A magnetic-flux conduit with a toroidal shape, such as conduit 801, can be fabricated as follows. First two half-toroids can be produced by stamping malleable sheet metal such as aluminum, copper, silver or other malleable electrically conducting material using a toroidal-shaped mold. Alternatively, sheet-metal-forming methods such as rolling, spinning, or drawing can be used to prepare the half-toroids. The half-toroids can then be welded together along one edge, leaving a gap between the two half-toroids at the other edge. The resulting toroidal-shaped conduit can then be annealed, if desired, to restore the material to a highly electrically conducting state. Also, a layer of electrically insulating material, such as those described previously, can be inserted into the gap to prevent electrical shorting across the gap.

Having provided a conduit 801 with an electrically insulating gap 807, the transformer 800 can be completed by adding the primary winding 803 and the secondary winding 805. These can be provided, for example, by winding insulated wire around the conduit 801 as illustrated in FIG. 8 with the necessary number of turns to provide the desired step-up or step-down voltage characteristic.

The transformer 800 can then be operated by providing a time-varying electrical current to the primary winding 803. Magnetic flux generated by the primary winding 803 is then guided through the interior region bounded by the conduit 801 to a region surrounded by the secondary winding 805. The magnetic flux guided to the secondary winding 805 thereby induces an electrical voltage in the secondary winding 805 according to the mutual inductance between the primary and secondary windings 803 and 805.

Most of the magnetic flux generated by the primary winding 803 circulates through the interior region bounded by the toroidal conduit 801 and, therefore, necessarily links the secondary winding 805, thereby providing tight coupling between the primary winding 803 and the secondary winding 805. Moreover, external fields are largely excluded from the interior of the toroidal conduit 801 and, therefore, do not couple strongly to either the primary winding 803 or the secondary winding 805.

The transformer 800 has a number of advantages compared to conventional magnetic-core transformers based on advantages of magnetic-flux conduits according to the present invention over conventional magnetic cores. For example, the conduit 801 of the transformer 800 has a low weight compared to much heavier magnetic-cores of conventional transformers. In addition, the conduit 801 of the transformer 800 does not suffer from hysteresis or eddy current losses such as are encountered with magnetic-cores of conventional transformers. In addition, the conduit 801 of the transformer 800 is perfectly linear, whereas magnetic cores of conventional transformers are non-linear. In addition, the conduit 801 of the transformer 800 does not suffer from the limitation of saturation magnetization encountered with magnetic cores of conventional transformers.

Figure 9:
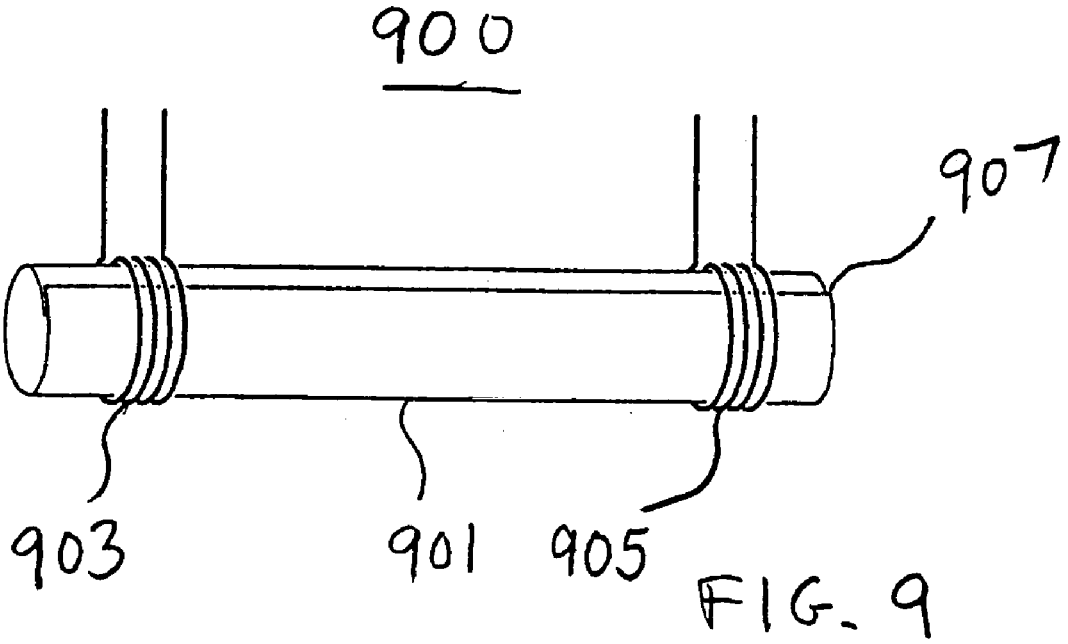
FIG. 9 is a schematic illustration of another exemplary transformer according to another aspect of the present invention.

In another aspect of the invention, there is provided another electrical transformer according to the present invention. FIG. 9 illustrates an exemplary electrical transformer 900 according to the present invention having a linear (as opposed to toroidal) cylindrical shape. The transformer 900 comprises a magnetic-flux conduit 901, a primary electrical winding 903 and a secondary electrical winding 905. An electrically insulating gap 907 is formed along the length of the conduit 901 such as has been previously described, for example, with regard to FIGS. 2A, 2B, 4 and 5. The conduit 901 can be formed using materials such as described previously, and the windings 903 and 905 can be prepared such as described above with regard to FIG. 8. The transformer 900 can be operated in the manner similar to that described above for transformer 800 illustrated in FIG. 8.

The transformer 900 provides advantages over conventional magnetic core transformers such as has been described above with regard to FIG. 8. In addition, the transformer 900 also provides tight coupling between the primary winding 903 and the secondary winding 905. However, because of the open-cylinder geometry, external fields are allowed to enter the flux conduit 901 at either end, which can therefore increase coupling of an external magnetic field to both coils.

Figure 10A:
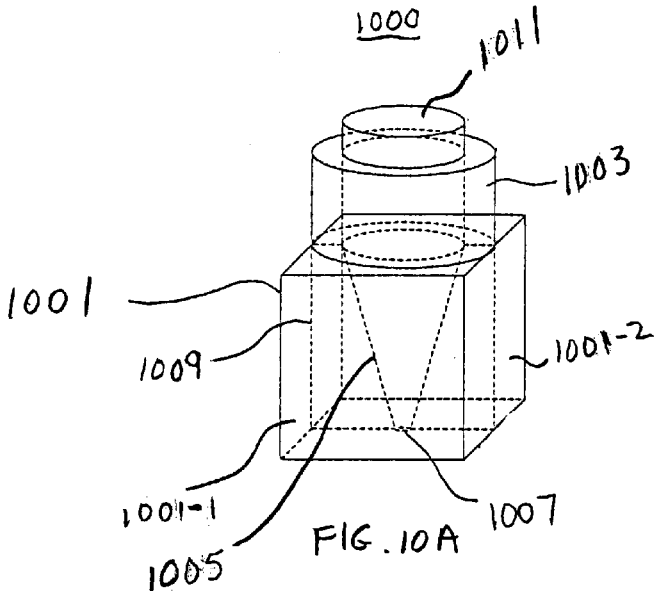
FIG. 10A is a perspective view of an exemplary magnetic flux concentrating apparatus according to an aspect of the present invention.
Figure 10B:
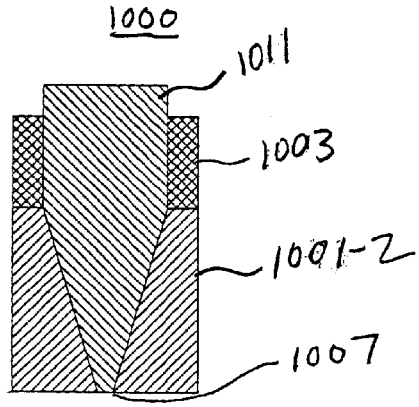
FIG. 10B is a cross-sectional view of the apparatus illustrated in FIG. 10A.

In another aspect of the invention there is provided a magnetic flux focusing apparatus that comprises a magnetic-flux conduit. FIG. 10A illustrates an exemplary magnetic flux focusing apparatus 1000 according to an aspect of the present invention. The apparatus 1000 comprises a magnetic-flux conduit 1001 that comprises a first electrically conducting block 1001-1 and a second electrically conducting block 1001-2 with an electrically insulating surface 1009 formed therebetween. In addition, the conduit 1001 is machined to have a conically shaped depression 1005 extending from one end of the conduit 1001 to an opposing end of the conduit 1001. An opening 1007 is provided at the narrow end of the conically shaped depression 1005 of the conduit 1001. In this example, the focusing apparatus 1000 also comprises a magnetic core 1011 with a cylindrically shaped upper portion and a conically shaped lower portion wherein the conically shaped lower portion fits into the conically shaped depression 1005 of the conduit 1001. An electrical coil 1003 having a cylindrical shape is disposed around the upper cylindrical portion of the magnetic core 1011. A cross-sectional view of the apparatus 1000 is illustrated in FIG. 10B where the cross section is at the electrically insulating surface 1009.

The blocks 1001-1 and 1001-2 can be held together, for example, by bonding the blocks 1001-1 and 1001-2 together using an epoxy resin at the electrically insulating surface 1009 before the conically shaped hole 1005 is machined. Alternatively, the blocks 1001-1 and 1001-2 can be held together mechanically using fasteners or clamps that are appropriately insulated to prevent electrical shorting across the electrically insulating surface 1009.

The magnetic core 1011 can be, for example, a powdered iron core or a core made of any permeable, low-loss magnetic material. The electrically conducting blocks 1001-1 and 1001-2 can be any conventional electrical conductor such as aluminum, copper, silver or other electrically conducting material. It can be beneficial to form the electrically conducting blocks 1001-1 and 1001-2 from aluminum or an aluminum alloy because the abutting surfaces of the blocks 1001-1 and 1001-2 can be machined to be very flat and can then be anodized to have a thin layer of aluminum oxide (or alloy oxide) disposed at each of the abutting surfaces. The anodization is carried out before the blocks 1001-1 and 1001-2 are bonded or otherwise held together. Aluminum oxide layers produced by anodization can be exceedingly thin, for example, several nanometers to tens or hundreds of nanometers in thickness. Where aluminum oxide layers provide electrical insulation, the width of the electrically insulating seam 1009 is limited only by the precision to which the blocks 1001-1 and 1001-2 can be machined flat. The above-described approach provides for achieving a very thin electrically insulating gap 1009 comprising aluminum oxide which can have a very low magnetic-flux leakage in view of the seam characteristics previously described. Thus, the apparatus 1000 configured as illustrated in FIG. 10A can provide a magnetic flux with a high field strength, limited only by heating of the flux conduit due to skin effect currents.

Figure 10D:
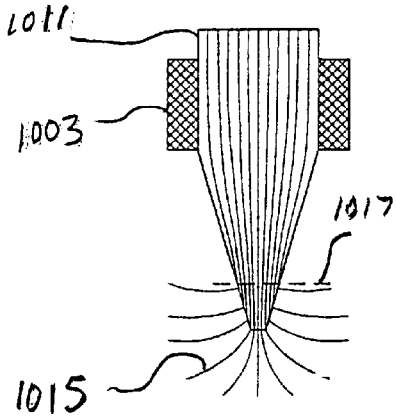
FIG. 10D is a cross-sectional illustration illustrating a reduction in the focusing of magnetic flux if the magnetic-flux conduit is removed from the apparatus illustrated in FIGS. 10A, 10B and 10C.
Figure 10C:
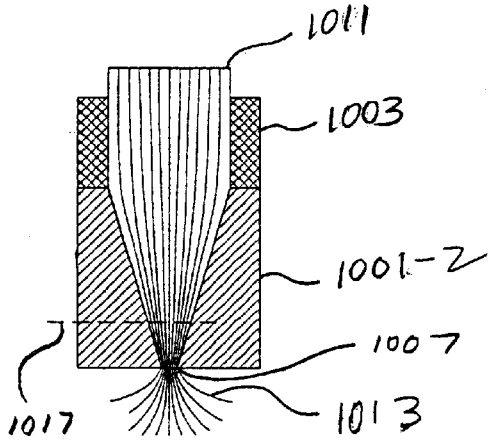
FIG. 10C is a cross-sectional view of the apparatus illustrated in FIGS. 10A and 10B showing focusing of magnetic flux.

FIG. 10C illustrates the configuration of magnetic flux 1013 guided through the interior region bounded by the magnetic-flux conduit 1001 and emanating from the opening 1007 at the bottom of the magnetic-flux conduit 1001. As illustrated in FIG. 10C, the magnetic field strength of the magnetic flux 1013 increases beyond the saturation value of the magnetic core 1011, which occurs at the location of the saturation point 1017 (dotted line), and a very high magnetic field strength is provided at the opening 1007.

For comparison, FIG. 10D illustrates the behavior of magnetic flux 1015 guided through and emanating from a magnetic core 1011 without a surrounding magnetic-flux conduit. As is evident from FIG. 10D, the saturation magnetization of the magnetic core 1011 limits the maximum magnetic field attainable at the narrow end of the conically shaped portion of the magnetic core 1011. The magnetic field becomes stronger in the magnetic core 1011 as the flux 1015 progresses down the taper, to the point where the magnetic core 1011 saturates. Beyond this point, the flux 1015 escapes the sides of the magnetic core 1011 and is no longer concentrated by the taper. Accordingly, the field strength of the magnetic flux lines 1015 is much less near the tip of the conically shaped portion of the magnetic core 1011 than the magnetic flux 1013 emanating from the opening 1007 shown in FIG. 10C.

By enclosing the magnetic core 1011 in a magnetic-flux conduit 1001 formed by the electrically conducting blocks 1001-1 and 1001-2 as shown in FIGS. 10A–10C, this limitation of the saturation magnetization is eliminated. In the geometry of the apparatus 1000 illustrated in FIG. 10A, current flow from block 1001-1 to 1001-2 and vice versa is prevented by the electrically insulating seam 1009. Accordingly, the electrically insulating seam 1009 prevents the magnetic-flux conduit 1001 formed from the blocks 1001-1 and 1001-2 from having a closed electrical path that links any closed path of the desired magnetic flux. Accordingly, the magnetic-flux conduit 1001 can guide and focus the magnetic flux 1013 without any limitation due to the saturation magnetization of the magnetic core 1011. Nevertheless, it can be beneficial to provide the magnetic core 1011 because the magnetic core provides a lower reluctance for the apparatus 1000 than would be obtained if the magnetic-flux conduit 1001 was provided without a magnetic core 1011.

Figure 11B:
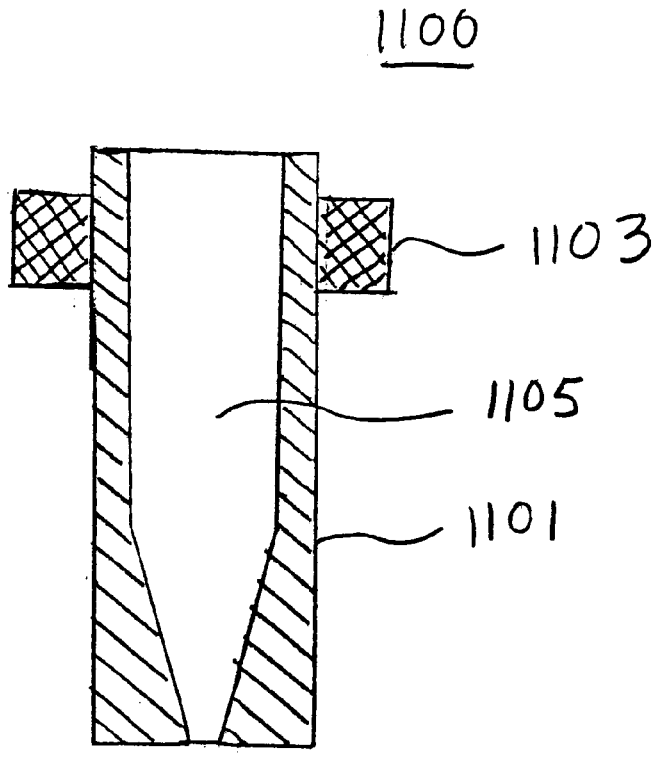
FIG. 11B is a cross-sectional view of the apparatus illustrated in FIG. 11A.
Figure 11A:
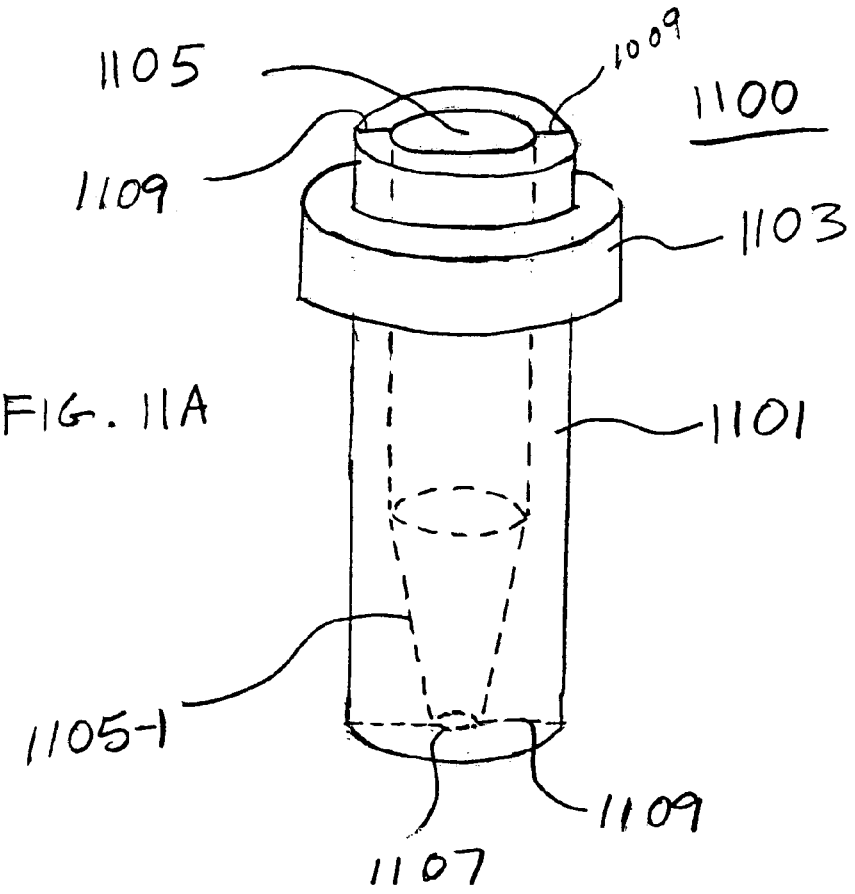
FIG. 11A is a perspective view of another exemplary magnetic flux concentrating apparatus according to another aspect of the present invention.

In another exemplary aspect of the invention, there is provided a magnetic flux focusing apparatus comprising a magnetic-flux conduit without a magnetic core. FIG. 11A illustrates a perspective view of a magnetic flux focusing apparatus 1100 according to an exemplary aspect of the present invention. The apparatus 1100 comprises an electrically conducting conduit 1101 having an electrically insulating gap 1009 formed along the length of the conduit 1101. The conduit 1101 also comprises an interior region (e.g., a hollow interior) 1105 having a tapered portion 1105-1 near one end. The apparatus 1100 further comprises an electrical coil 1103 that surrounds a first portion of the conduit 1101 near one end of the conduit 1101. The electrical coil 1103 produces a time-varying magnetic flux that passes through the interior region 1105 of the conduit 1101. A cross sectional view of the apparatus 1100 is shown in FIG. 11B. An interior cross-sectional area of a second portion of the conduit at the small end (opening 1107) of the tapered portion 1105-1 is smaller than the interior cross sectional area of the first portion of the conduit 1101 surrounded by the coil 1103.

The conduit 1101 can be formed by anodizing and epoxying two aluminum blocks such as described above with regard to FIG. 10. The epoxied aluminum blocks can then be machined to produce the interior region 1105 with the tapered (e.g., conically shaped) portion 1105-1. A coil 1103 can then be disposed around a portion of the conduit 1101, such as illustrated in FIGS. 11A and 11B. The operation of the apparatus is similar to that described with regard to FIG. 10, except that no magnetic core is provided in the apparatus 1100. By not providing a magnetic core with the apparatus 1100, the apparatus 1100 can be provided with a lower weight. However, the apparatus 1100 will also have a relatively higher reluctance than would otherwise be obtained if a magnetic core were also provided. By energizing the coil 1103 with an alternating current, a high strength magnetic flux can thereby be provided at the opening 1107 of the conduit 1101. The physical principles governing the operation of the apparatus 1100 have already been described above.

The embodiments described above are intended to be exemplary in nature and not restrictive in any way. Accordingly, many variations of the embodiments described above exist. For example, various magnetic-flux conduits have been described above as having overall exterior and/or interior circular cross-sectional shapes. However magnetic-flux conduits according to the present invention are not limited to circular cross sections, and other cross-sectional shapes, such as squares, rectangles, ovals and essentially any other desired shape, can be used. In addition, a magnetic flux conduit according to the present invention can have an interior cross-sectional shape that differs from its exterior cross-sectional shape. Moreover, embodiments have been described above as utilizing an electrical coil as a source of a time-varying magnetic flux. However, the source of time-varying magnetic flux is not restricted to a coil and other sources, such as a permanent magnet mounted to a mechanically reciprocating stage, could also be used wherein an end of the permanent magnet oscillates back and forth within one end of a magnetic-flux conduit. In this regard, it will be recognized that even though a permanent magnet oscillating in this manner has a DC magnetic field component as well as AC magnetic field components, only the AC magnetic field components will be guided to the opposing end of the magnetic-flux conduit. In this regard, the magnetic-flux conduit can also be viewed as acting as a high pass filter that only passes AC components of a time-varying magnetic flux.

In addition, various embodiments have been described in which the magnetic-flux conduit is formed of a conventional electrical conducting material and wherein the magnetic-field source is a source of time-varying magnetic field, such as an electrical coil. However, magnetic flux conduits according to the present invention can also be formed using superconducting materials such as yttrium-barium-copper-oxide materials, bismuth-strontium-calcium-copper-oxide materials, and other high-temperature superconducting materials, for example. Where a superconducting material is used, the magnetic-field source can be a source of constant magnetic field (also referred to as DC magnetic field), such as a permanent magnet. Of course, a source of time-varying magnetic field, such as an electrical coil, can also be used with a superconducting magnetic-flux conduit.

In addition, various embodiments have been described above wherein the magnetic-flux conduit is hollow. However, the interior of the magnetic-flux conduit can alternatively be filled with an electrically insulating material, such as thermoplastic resin (e.g., Lucite™), PVC, or other electrically insulating materials. As another alternative, it is also possible to provide one or more magnetic cores within an otherwise hollow magnetic-flux conduit such that the magnetic cores do not electrically short the electrically insulating gap of the magnetic-flux conduit. Where a plurality of magnetic cores are used, the magnetic cores can be in contact with each other or separate from each other. For example, the interior surface of the magnetic-flux conduit can be provided with an electrically insulating layer to prevent electrical shorting, or the exterior surfaces of the magnetic cores can be coated or covered with an electrically insulating material. By providing one or more magnetic cores within a magnetic-flux conduit according to the present invention, the reluctance of the magnetic-flux conduit is thereby reduced. Utilizing magnetic cores in this manner can be beneficial where the reluctance of a hollow magnetic-flux conduit is otherwise expected to be high (e.g., a long magnetic-flux conduit).

The invention has been described with reference to particular embodiments. However, it will be readily apparent to those skilled in the art that it is possible to embody the invention in specific forms other than those of the embodiments described above. This can be done without departing from the spirit of the invention. The embodiments described herein are merely illustrative and should not be considered restrictive in any way. The scope of the invention is given by the appended claims, rather than the preceding description, and all variations and equivalents which fall within the range of the claims are intended to be embraced therein.

What is claimed is:

1. A method of making a magnetic-flux conduit, comprising:

identifying one or more mathematical surfaces through which leakage of a desired magnetic flux is to be prevented;

providing electrically conducting material that conforms to said one or more mathematical surfaces; and providing an electrically insulating gap in the electrically conducting material such that no closed electrical path of the electrically conducting material links a closed path of the desired magnetic flux, wherein an interior region of a magnetic-flux conduit thereby formed has a tapered shape between a first portion of the magnetic-flux conduit and a second portion of the magnetic-flux conduit.

2. The method of claim 1, wherein the interior region of the magnetic-flux conduit is hollow.

3. The method of claim 1, wherein the electrically conducting material is selected from the group consisting of copper, aluminum and silver.

4. The method of claim 1, further comprising providing at least one permeable magnetic core within an the interior region of the magnetic-flux conduit.

5. The method of claim 1, wherein the electrically conducting material comprises a superconducting material.

6. The method of claim 5, wherein the superconducting material is selected from the group consisting of yttrium-barium-copper-oxide materials and bismuth-strontium-calcium-copper-oxide materials.

7. A method of providing a magnetic flux, comprising:

providing a conduit having a wall that comprises an electrically conducting material, wherein an electrically insulating gap is formed in the wall along an entire length of the conduit, and wherein the electrically insulating gap prevents the conduit from having a closed electrical path that links any closed path of desired magnetic flux;

providing a magnetic material within an interior region of the conduit;

providing a magnetic-field source in proximity to the conduit; and operating the magnetic-field source to produce a magnetic flux that passes through the magnetic material and the interior region of the conduit such that a flux density of the magnetic flux exceeds a saturation magnetization of the magnetic material.

8. The method of claim 7, wherein the magnetic-field source is operated to produce a time-varying magnetic field.

9. The method of claim 7, wherein the magnetic-field source is an electrical coil.

10. The method of claim 7, wherein the electrically conducting material is selected from the group consisting of copper, aluminum and silver.

11. The method of claim 7, wherein the electrically conducting material comprises a superconducting material.

12. The method of claim 11, wherein the superconducting material is selected from the group consisting of yttrium-barium-copper-oxide materials and bismuth-strontium-calcium-copper-oxide materials.

13. The method of claim 7, wherein the interior region bounded by the conduit has a first interior cross-sectional area at a first portion the conduit, the interior region bounded by the conduit has a second interior cross-sectional area at a second portion of the conduit, the magnetic-field source is disposed in proximity to the first portion of the conduit, and the second interior cross-sectional area is smaller than the first interior cross-sectional area.

14. The method of claim 13, wherein the interior region bounded by the conduit has a tapered shape between the first portion of the conduit and the second portion of the conduit.

15. A method of providing a magnetic flux, comprising:

providing a conduit having a wall that comprises an electrically conducting material, wherein an electrically insulating gap is formed in the wall along an entire length of the conduit, and wherein the electrically insulating gap prevents the conduit from having a closed electrical path that surrounds a lengthwise axis of the of the conduit;

providing a magnetic material within an interior region of the conduit;

providing a magnetic-field source in proximity to the conduit; and operating the magnetic-field source to produce a magnetic flux that passes through the magnetic material and through the interior region of the conduit such that a flux density of the magnetic flux exceeds a saturation magnetization of the magnetic material.

16. The method of claim 15, wherein the magnetic-field source is operated to produce a time-varying magnetic field.

17. The method of claim 15, wherein the magnetic-field source is an electrical coil.

18. The method of claim 15, wherein the electrically conducting material is selected from the group consisting of copper, aluminum and silver.

19. The method of claim 15, wherein the electrically conducting material comprises a superconducting material.

20. The method of claim 19, wherein the superconducting material is selected from the group consisting of yttrium-barium-copper-oxide materials and bismuth-strontium-calcium-copper-oxide materials.

21. The method of claim 15, wherein the interior region of the conduit has a first interior cross-sectional area at a first portion the conduit, the interior region of the conduit has a second interior cross-sectional area at a second portion of the conduit, the magnetic-field source is disposed in proximity to the first portion of the conduit, and the second interior cross-sectional area is smaller than the first interior cross-sectional area.

22. The method of claim 21, wherein the interior region bounded by the conduit has a tapered shape between the first portion of the conduit and the second portion of the conduit.

23. A method of providing a magnetic flux, comprising:

providing a conduit having a wall that comprises an electrically conducting material, wherein an electrically insulating gap is formed in the wall along an entire length of the conduit, wherein the electrically insulating gap prevents the conduit from having a closed electrical path that surrounds a lengthwise axis of the of the conduit, and wherein magnetic material is excluded from an interior region of the conduit;

providing an electrical coil that surrounds a portion of the conduit; and applying electrical energy to the coil to produce a magnetic flux that passes through the interior region of the conduit.

24. The method of claim 23, wherein the electrically conducting material is selected from the group consisting of copper, aluminum and silver.

25. The method of claim 23, wherein the electrically conducting material comprises a superconducting material.

26. The method of claim 25, wherein the superconducting material is selected from the group consisting of yttrium-barium-copper-oxide materials and bismuth-strontium-calcium-copper-oxide materials.

27. The method of claim 23, wherein the interior region bounded by the conduit has a first interior cross-sectional area at a first portion the conduit, the interior region of the conduit has a second interior cross-sectional area at a second portion of the conduit, the coil is disposed in proximity to the first portion of the conduit, and the second interior cross-sectional area is smaller than the first interior cross-sectional area.

28. The method of claim 27, wherein the interior region of the conduit has a tapered shape between the first portion of the conduit and the second portion of the conduit.

* * * * *

UNITED STATES PATENT AND TRADEMARK OFFICE

CERTIFICATE OF CORRECTION

PATENT NO. : 6,720,855 B2
DATED : April 13, 2004
INVENTOR(S) : Leandra Vicci

It is certified that error appears in the above-identified patent and that said Letters Patent is hereby corrected as shown below:

Column 16,
Line 57, delete “within an the interior” and insert therefore -- within the interior --.

Column 17,
Line 51, delete “of the of the conduit” and insert therefore -- of the conduit --.

Column 18,
Line 14, delete “portion the conduit” and insert therefore -- portion of the conduit --.
Line 32, delete “of the of the conduit” and insert therefore -- of the conduit --.
Line 50, delete “portion the” and insert -- portion of the --.

Signed and Sealed this

Twenty-eighth Day of December, 2004

JON W. DUDAS
*Director of the United States Patent and Trademark Office*